US005705764A

United States Patent [19]

Schade et al.

[11] Patent Number: 5,705,764

[45] Date of Patent: Jan. 6, 1998

[54] INTERLAYER FOR CERAMIC ARMOR

[75] Inventors: David Arthur Schade, San Carlos; James Edward Drotleff, Dublin; Ronald Eugene Musante, Los Altos; Michael Brian McArthur, San Jose; Torrey Lane Pike, Danville; Vernon Curtis Krueger, San Jose; George Edgar Thomas, Jr., Palo Alto; Mark Albert Middione, Scotts Valley, all of Calif.

[73] Assignee: United Defense, L.P., Arlington, Va.

[21] Appl. No.: 657,700

[22] Filed: May 30, 1996

[51] Int. Cl.[6] ..... F41H 5/04

[52] U.S. Cl. ..... 89/36.02; 89/36.08; 428/911

[58] Field of Search ..... 89/36.01, 36.02, 89/36.08; 109/49.5; 428/911

[56] References Cited

U.S. PATENT DOCUMENTS

| | | | |
|---|---|---|---|
| 4,743,497 | 5/1988 | Thorsrud | 428/911 |
| 4,948,673 | 8/1990 | Goeuvy | 428/911 |
| 5,326,606 | 7/1994 | Labock | 428/911 |

FOREIGN PATENT DOCUMENTS

| | | | |
|---|---|---|---|
| 2300191 | 9/1976 | France | 89/36.02 |
| 2613823 | 10/1988 | France | 89/36.02 |

OTHER PUBLICATIONS

Hawley, The Condensed Chemical Dictionary, pp. 705, 706, 865, ©1971.

Webster, Ninth New Collegiate Dictionary, p. 912, ©1983.

*Primary Examiner*—Stephen M. Johnson

*Attorney, Agent, or Firm*—Michael B. K. Lee; Douglas W. Rudy

[57] ABSTRACT

The invention provides an improved method and apparatus for bonding ceramic tiles to armor. The invention uses a toughened epoxy adhesive and a rubber interlayer to improve the bonding of ceramic tile to armor. A scrim cloth is embedded in adhesive layers to serve as a wick and spacer to uniformly distribute the epoxy.

9 Claims, 1 Drawing Sheet

INTERLAYER FOR CERAMIC ARMOR

BACKGROUND OF THE INVENTION

The present invention relates generally to armor with a ceramic facing.

In the prior art, ceramic tiles were bonded directly to a vehicle hull or substrate by an adhesive. With such prior art adhesives, a single hit to the armor would remove several tiles, making the armor unable to withstand multiple hits in an area.

SUMMARY OF THE INVENTION

It is an object of the invention to provide a method and apparatus for bonding ceramic tiles to armor in a more secure manner.

It is another object of the invention to provide ceramic tile armor that can sustain multiple hits.

The invention provides an improved method and apparatus for bonding ceramic tiles to armor. The invention uses a toughened epoxy adhesive and a rubber interlayer to improve the bonding of ceramic tile to armor.

DESCRIPTION OF THE PREFERRED EMBODIMENTS

Figure 1:
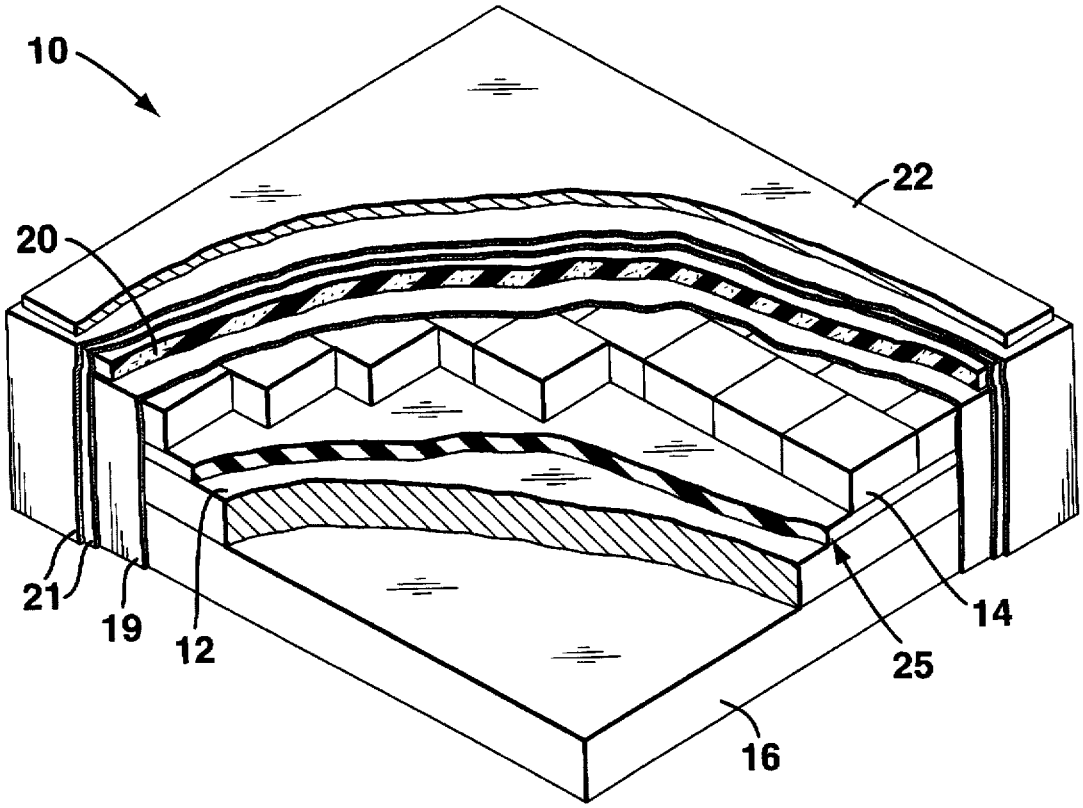
FIG. 1 is a cut away perspective view of a preferred embodiment of the invention.

A ceramic armor system 10, as shown in FIG. 1, may be used on a military vehicle or for other types of armor protection. A ceramic armor system 10, comprises a structural support layer 12 and a layer of ceramic tiles 14. In the preferred embodiment illustrated in FIG. 1, a spall layer 16 is provided to minimize spallation of the structural support layer 12. A covering layer comprising a 1 ply KEVLAR layer 19 with a Urelite adhesive, a PVC foam layer 20, a 2 ply KEVLAR layer 21 with a Urelite adhesive, and a steel plate 22, covers the layer of ceramic tiles 14. An inventive attachment layer 25 is used to connect the layer of ceramic tiles 14 to the structural support layer 12.

Figure 2:
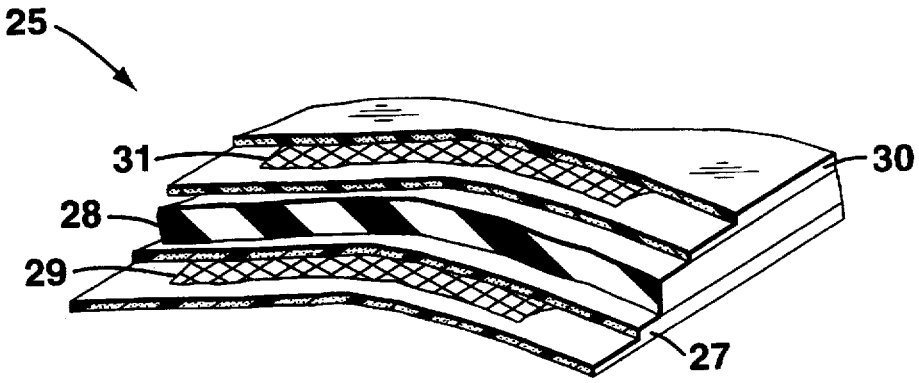
FIG. 2 illustrates a detailed perspective view of the attachment layer illustrated in FIG. 1.

FIG. 2 illustrates a detailed perspective view of the attachment layer 25 illustrated in FIG. 1. The attachment layer 25, comprises a first layer of epoxy 27 between a first side of the structural support layer 12 and a first side of a layer of EPDM rubber 28, a first scrim cloth 29, which comprises an open weave of fiberglass material embedded in the first layer of epoxy 27, a second layer of epoxy 30 between a second side of the layer of EPDM rubber 28 and a first side of the layer of ceramic tiles 14, and a second scrim cloth 31, which comprises an open weave of fiberglass material embedded in the second layer of epoxy 30. In this preferred embodiment, the structural support layer 12 is made of titanium. The ceramic tiles of the layer of ceramic tiles 14 are Cercom hot pressed silicon carbide Type N tiles made by Cercom Incorporated at 1960 Watson Way, Vista, Calif. 92063.

In the manufacture of the preferred embodiment the structural support layer 12 is first prepared by removing all oil and grease from the surface of the structural support layer, and then by sand blasting or grinding the surface to be bonded. The first and second sides of the layer of EPDM rubber 28 are sanded with 80-grit paper, so that the surface gloss is removed. The ceramic tiles of the layer of ceramic tiles 14 are cleaned. Loose debris is removed from the PVC foam layer 20. The surface to be bonded of the steel plate 22 is cleaned and sand blasted or ground. The layer of ceramic tiles 14, the layer of EPDM rubber and the structural support layer 12 are primed. The primer promotes surface bonding with the adhesive. SC-11 epoxy, which is a toughened epoxy made by Applied Polermeric Incorporated (API) at 850 Teal Drive, Benicia, Calif. 94510, is mixed and 5% by weight of fumed silica is mixed into the epoxy to thicken the epoxy and make it easier to work with. The epoxy is spread over the first side of the structural support layer 12. The first scrim cloth 29 is placed on the epoxy spread over the first side of the structural support layer 12. Epoxy is spread over the first scrim cloth 29, thus forming the first layer of epoxy 27 with the first scrim cloth 29 embedded therein. The first scrim cloth 29 serves as a wick and spacer to uniformly distribute the epoxy between the layer of EPDM rubber 28 and the ceramic tiles 14. The layer of EPDM rubber 28 is placed on the first layer of epoxy 27. Epoxy is spread over the second side of the layer of EPDM rubber 28. The second scrim cloth 31 is placed over the epoxy spread over the second side of the layer of EPDM rubber 28. Epoxy is spread over the second scrim cloth 31, thus forming the second layer of epoxy 30 with the second scrim cloth 31 embedded therein. The layer of ceramic tiles 14 is placed on the second layer of epoxy 30. Epoxy is placed over the tiles to fill in gaps, and allowed to cure over night. The dimension of the gap between the tiles is between 0.010 inches and 0.10 inches. When protection between multiple hits is desired a gap of 0.015 inches is preferred. When protection from small threats is desired a gap of 0.080 is preferred.

The 1 ply KEVLAR layer 21 is primed and then bonded to the layer of ceramic tiles 14 using Hexcel Uralite 3148 adhesive. Hexcel Uralite 3148 adhesive is also used to bind a first side of the PVC foam layer 20 to the 1 ply KEVLAR layer 21. The 2 ply KEVLAR layer 21 is placed on a second side of the PVC foam layer 20. The 2 ply KEVLAR layer 21 and the PVC foam layer 20 are saturated with Hexcel Uralite 3148 adhesive. Hexcel Uralite 3148 adhesive is applied to a first side of the steel plate 22. The first side of the steel plate 22 is placed against the 2 ply KEVLAR layer 21. The spall layer 16 is mechanically connected to a second side of the structural support layer 12 by an adhesive.

The structural support layer 12 forms part of a military vehicle or a building, where protection from munitions is desirable. When the armor system 10 in the preferred embodiment was hit with a projectile, the inventive attachment layer 25 minimized ceramic tile displacement, by limiting the tiles removed or damaged by the projectile to a small area.

In other embodiments, the structural support layer 12 may be a composite material or other armor materials. Other ceramic or ceramic like materials may be used to make the ceramic tiles 14. The spall layer 16 may be removed or changed. The covering layers may also be removed or changed. Other types of adhesives may used instead of SC-11 epoxy. Other elastomer materials may be used in place of EPDM rubber replacing the layer of EPDM rubber with an elastomer layer. Other embodiments may leave out the scrim cloth or use a scrim cloth of a different material.

While preferred embodiment of the present invention has been shown and described herein, it will be appreciated that various changes and modifications may be made therein without departing from the spirit of the invention as defined by the scope of the appended claims.

What is claimed is:

1. An armor system, comprising:

an structural support layer;

an elastomer layer with a first side and a second side with the first side of the elastomer layer adjacent to a first side of the structural support layer;

a first adhesive layer binding the first side of the structural support layer to the first side of the elastomer layer;

a plurality of tiles forming a layer of tiles with a first side and a second side, wherein the first side of the layer of tiles is adjacent to the second side of the elastomer layer; and a second adhesive layer binding the second side of the elastomer layer with the first side of the layer of tiles;

a first scrim cloth embedded in the first adhesive layer; and a second scrim cloth embedded in the second adhesive layer.

2. The armor system, as claimed in claim 1, wherein the scrim cloth is a net of fiberglass material.

3. The armor system, as claimed in claim 2, wherein the elastomer layer is EPDM rubber.

4. The armor system, as claimed in claim 3, wherein the first adhesive layer and the second adhesive layer are epoxy layers.

5. The armor system, as claimed in claim 4, wherein the plurality of tiles forming a layer of tiles have a gap between the plurality of tiles that is in the range between 0.010 inches and 0.10 inches.

6. An armor system, comprising:

an structural support layer;

an elastomer layer with a first side and a second side with the first side of the elastomer layer adjacent to a first side of the structural support layer;

a first adhesive layer binding the first side of the structural support layer to the first side of the elastomer layer;

a plurality of tiles forming a layer of tiles with a first side and a second side, wherein the first side of the layer of tiles is adjacent to the second side of the elastomer layer; and a second adhesive layer binding the second side of the elastomer layer with the first side of the layer of tiles, wherein the elastomer layer is EPDM rubber.

7. The armor system, as claimed in claim 6, wherein the first adhesive layer and the second adhesive layer are epoxy layers.

8. A method of manufacturing an armor system, comprising the steps of:

applying an adhesive on a first side of a structural support layer;

placing a first layer of scrim cloth on the adhesive on the first side of the structural support layer;

applying a layer of adhesive on the first layer of scrim cloth;

placing a first side of an elastomer layer on the layer of adhesive on the first layer of scrim cloth;

applying a layer of adhesive on a second side of the elastomer layer;

placing a second layer of scrim cloth on the layer of adhesive on the second side of the elastomer layer;

applying a layer of adhesive on the second layer of scrim cloth; and placing a layer of ceramic tiles on the layer of adhesive on the second layer of scrim cloth.

9. The method, as claimed in claim 8, further comprising the steps of, mixing the adhesive, which comprises the steps of:

mixing epoxy; and adding fumed silica to the epoxy.

* * * * *